United States Patent [19]

Sutter

[11] 4,214,434

[45] Jul. 29, 1980

[54] ELECTRONIC WATCHES

[75] Inventor: Hans-Rudolf Sutter, Pieterlen, Switzerland

[73] Assignee: Bulova Watch Company, Inc., Flushing, N.Y.

[21] Appl. No.: 968,694

[22] Filed: Dec. 12, 1978

[30] Foreign Application Priority Data

Dec. 16, 1977 [CH] Switzerland ..... 15504/77

[51] Int. Cl.[2] ..... G04C 3/00

[52] U.S. Cl. ..... 368/71; 368/80; 368/218

[58] Field of Search ..... 58/23 R, 23 D, 23 BA, 58/23 TF, 23 V; 310/68 R; 318/696

[56] References Cited

U.S. PATENT DOCUMENTS

| | | | |
|---|---|---|---|
| 3,341,723 | 9/1967 | Tourtellot | 310/68 R |
| 3,817,021 | 6/1979 | Bergey | 58/50 R |
| 4,106,279 | 8/1978 | Martin et al. | 58/23 BA |

*Primary Examiner*—Ulysses Weldon
*Attorney, Agent, or Firm*—Michael Ebert

[57] ABSTRACT

A miniature electronic timepiece whose analog-display time-indicating hands are driven by the rotor of a stepping motor actuated by low-frequency periodic timing pulses derived by frequency division from a high-frequency crystal-controlled time base. The motor, in addition to a stator coil wound on a core, includes an auxiliary coil wound on the same core to define a transformer whose primary is the auxiliary coil and whose secondary is the stator coil. To power the electronic watch, a voltage at a predetermined level is required, this being supplied by a converter formed by an electronic chopper interposed between the primary of the transformer and a d-c source whose output is at a different voltage level. Thus the d-c voltage applied to the primary is periodically interrupted, the resultant a-c voltage yielded by the secondary being rectified to provide the desired power voltage.

8 Claims, 3 Drawing Figures

ELECTRONIC WATCHES

BACKGROUND OF INVENTION

The present invention relates to a miniature electronic timepiece whose time indicating hands are driven by a stepping motor.

In small electronic timepieces (miniature electronic timepieces), the available voltage of the d.c. feed source (miniature battery, solar cells, etc.) does not always have the value required for powering the timepiece or individual components thereof. For this reason, it has already been proposed to chop the voltage of the d.c. source to produce a periodic voltage and then to effect transformation thereof, whereupon the transformed voltage is rectified, thus making available a voltage which is higher or lower than the voltage of the feed source.

The reduction of the feed voltage can for example be meaningful if it is desired to feed an integrated circuit with a voltage which is lower than the voltage of a feed voltage battery, so as to keep the current consumption of the circuit at the lowest possible level and thereby to prolong the service life of the battery. In actual fact, the power requirements of such a circuit is proportional to the square of the voltage. Thus, it is desirable to keep at the lowest possible level the feed voltage of the solid state circuit, in particular of the oscillator circuit operating at relatively high frequency and normally stabilized by a quartz crystal. For example reduction of the d.c. voltage feeding the solid state circuit by 50% reduces the energy consumption by 75%.

In other cases, it is desirable to increase an available voltage (since electrochromic or other display elements require a higher voltage than the remaining components of the timepiece, or because it is desired to feed the timepiece with a thermo-element battery, a solar cell battery or the like, i.e. with a source of energy the voltage of which does not attain the value normally required for entirely satisfactory operation of the timepiece).

The need to provide a voltage converter in such a miniature timepiece constitutes a drawback. On the one hand, such a voltage converter, since it requires a transformer, relatively costly. Moreover the voltage transformer requires an excessive amount of space. These disadvantages are contrary to the demands made on modern electronic timepieces (simple and inexpensive manufacturability, a design as compact as possible, accompanied by a high order of accuracy and reliability).

For some time, there have been manufactured and put on the market to an increasing extent quartz crystal-wrist watches the hands of which are driven by a stepping motor. Also in such cases, an increase or reduction of the d.c. voltage frequency appears to be desirable (for example for feeding digital display elements in order to display the seconds and/or the display of a stopped time period). However, the stepping motor is relatively bulky, thus leaving little space for a voltage transformer. As a consequence the space problem in such watches is troublesome.

SUMMARY OF INVENTION

According to the invention, the technical problem referred to in the foregoing section is solved by the arrangement whereby the winding of the voltage transformer surrounds the ferromagnetic core of the stepping motor.

Fundamentally, it would be possible to employ for voltage transformation an induction coil fed by pulses having a steep edge. However, it has been found that this arrangement is not practical, due to the fact that the coil must exhibit a quality factor sufficiently high for effective operation. In most cases, therefore, the voltage transformer for a converter in accordance with the invention will be designed as an auto transformer (a single winding having an intermediate tap) or as a transformer having separate windings; in this latter case, depending on circumstances, the motor stator coil which is in any case provided, simultaneously constitutes a winding of the voltage transformer.

In order for the voltage transformer to carry out its task, it must be fed by pulses. For this purpose a voltage chopper is employed. The expression "voltage chopper" is used herein in its widest possible sense.

OUTLINE OF DRAWINGS

An example of embodiment of the subject of the invention is described hereinbelow with reference to the drawings which illustrate a wrist watch having a thermo-element battery for powering the circuits and the stepping motor driving the analog display hands, and also for charging a buffer accumulator supplying the timepiece with current when it is not carried on the wrist of the wearer.

In the drawings:

FIG. 3 shows the integrated chip arrangement of the electronic watch.

DESCRIPTION OF INVENTION

Figures 1, 2:
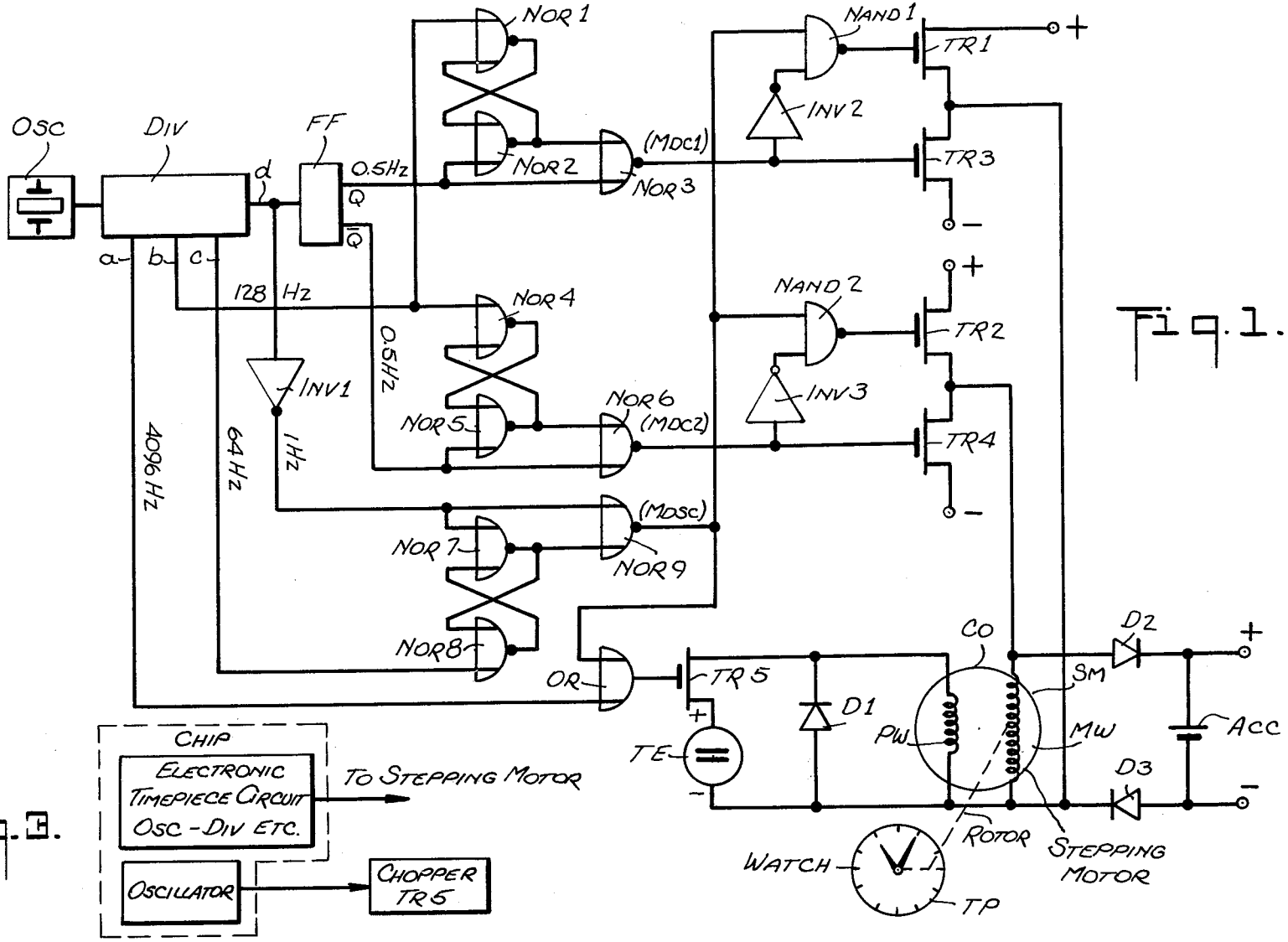
FIG. 1 shows a simplified diagram of the electronic circuit.
FIG. 2 shows a pulse diagram.
Figure 2:
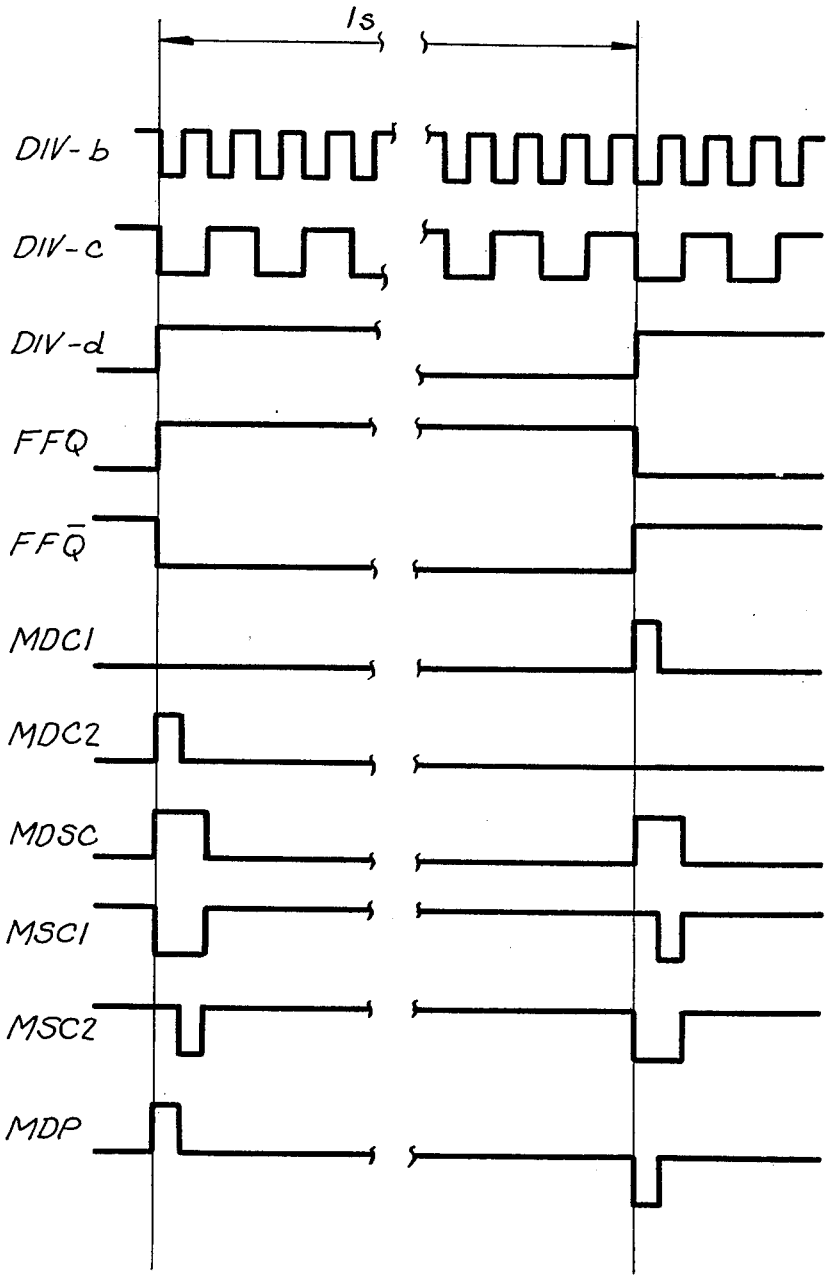

The watch shown in the drawings is controlled in a conventional manner by an oscillation circuit OSC containing a quartz crystal for stabilizing the frequency and transmitting pulses having a frequency of for example 32768 Hz to a 15-stage frequency divider DIV. Each stage divides the frequency by two, so that finally there are obtained pulses having a frequency of 1 Hz. In a flip-flop FF (which may be considered to be a further frequency divider stage), further halving of the frequency takes place. At the outputs Q and $\overline{Q}$ of this flip-flop, there are transmitted at a frequency of 0.5 Hz, pulses complementary to each other having a length of 1 second each.

It will now be assumed that the logic control circuit described in detail hereinbelow has the task of so controlling a driver stage, comprising four MOS transistors TR1–TR4 connected in complementary pairs, for the stator winding MW of a stepping motor SM driving the hands of the timepiece TP that this winding is fed, alternating with each second, with a positive or a negative pulse MDF. Hence what is involved is a bipolar motor, i.e. for example a motor, the ferromagnetic stator core CO of which has an elongated section. The stator winding MW is also effective as the secondary winding of a voltage transformer whose primary winding PW is also wound on the elongated section of the core to constitute a cylindrical coil.

In order that drive pulses having a precisely defined duration may be transferred to the stator winding, a two-part, logic pulse length decoder circuit is provided. This system comprises on the one hand the NOR gates NOR1–NOR3 and on the other hand the NOR gates NOR4–NOR6. Both gate groups are connected to a 128 Hz output b of an intermediate stage of the frequency divider DIV and respectively to one output Q and $\overline{Q}$ of the flip-flop FF.

Referring to the diagram according to FIG. 2, the pulse series DIV-b, DIV-c and DIV-d yielding at the outputs b, c, and d of the frequency divider are shown separately. These pulses occur at frequencies of 128 Hz, 64 Hz, and 1 Hz. The 0.5 Hz pulses which can be taken off from outputs Q and $\overline{Q}$ of flip-flop FF are designated FFQ and FF$\overline{Q}$ in FIG. 2.

With the aid of the pulse length decoder circuit, there may be derived from the DIV-b pulses and from the FFQ or FF$\overline{Q}$ pulses the control pulses MDC 1 and MDC 2 (also shown on the diagram) for the motor drive.

These control pulses MDC1 or MDC2 arriving from the NOR gate NOR 3 or NOR 6 are fed to the gate electrode of the transistor TR3 or TR4, so as to render these transistors conductive. By reason of the duration of pulses MDC1 and MDC2, current flows through the drive winding MW, i.e. once in one direction (via TR3 and TR2) and once in the opposite direction (via TR4 and TR1). The length of the control pulses MDC1 and MDC2 and also of the motor drive pulses proper (in the diagram, designated "MDP") is approximately 4 ms.

Immediately after the end of a drive pulse, the rotor is braked by temporarily short circuiting stator winding MW. In the present example, this results from the fact that the transistor TR3 or the transistor TR1 is blocked (depending on whether the preceding drive pulse is positive or negative) and the transistor TR4 or the transistor TR2 is rendered conductive. During a short circuiting period of approximately 4 ms, only the transistors TR1 and TR2 are conductive. Thereupon, up to the next drive pulse all transistors TR1–TR4 pass over into the blocking condition.

Control of the intermittent short circuiting of the stator winding is effected by the logic decoder circuit described hereinbelow:

With a 64 Hz output c of the frequency divider DIV and, via an inverter INV1, with the 1 Hz output d of this divider, there are connected the inputs of a linking circuit comprising three NOR gates NOR7–NOR9, two inverters INV2 and INV3 and also the NAND gates NAND1 and NAND2. The form and length of the pulses MDSC transmitted by the NOR gate NOR9 is apparent from the FIG. 2. Additionally, the diagram shows the position and magnitude of the pulse sequences MSC1 and MSC2 derived from the gates NAND1 and NAND2.

The watch, in the embodiment shown in FIG. 1 is equipped with a thermo-element battery TE as source of energy. The voltage provided by a source of this kind is, when compared with the voltage required for powering the watch, extremely small. For this reason, the voltage produced by the thermo-element battery TE is increased to the necessary degree by a voltage converter. This voltage converter comprises a voltage chopper in the form of a transistor TR5, the gate electrode of which is fed from output a of the divider DIV with actuating pulses having a frequency of 4090 Hz, and it also comprises a voltage transformer having primary winding PW and secondary winding MW and also rectifier diodes D2 and D3. In practice, the actuating pulses for operating the chopper TR5 may be derived from a separate pulse oscillator energized by the power supply rather than from pulses taken from divider DIV. This oscillator may be integrated on the same chip containing the electronic circuits of the timepiece as shown in FIG. 3. These two diodes bring about rectification of the secondary voltage and prevent short circuiting of the buffer accumulator ACC via the winding MW or via the transistors TR1–TR4. A further diode D1 protects the transistor TR5 and the element battery TE against excessive voltage induced in the winding PW.

Also from the circuit diagram in to FIG. 1 it will be evident that the voltage transformer and the stator of the motor constitute a structural unit. The stator winding provides a further function, i.e. as the transformer secondary winding for stepping up the chopped voltage of the thermo-element battery.

The pulses MDSC (cf. FIG. 2) appearing at the output of the NOR gate NOR9 extend both over the duration of the drive pulses MDP and also over the duration of the short circuit interval. Thus, it becomes possible with these pulses to avoid interference between the various functions of the circuit. This object is effected by an OR gate the inputs of which are connected respectively to the output of the frequency divider and the output of gate NOR9. As soon as an MDSC pulse is available, the gate electrode of the transistor TR5 receives a potential which blocks it, whereby the 4096 Hz pulses arriving at the end of this blocking pulse become ineffective.

The circuit can be altered in many ways. In some cases, it might for example be desirable to interrupt the connection between the voltage transformer and the circuits fed by the latter during feeding of the stator coil and optionally for the duration of short circuiting thereof, with the aid of logic switching means, so as to prevent disturbing circuit interactions.

What we claim is:

1. A miniature electronic timepiece having an analog display provided by time-indicating hands, said timepiece comprising:

A. circuit means requiring a direct energizing voltage at a predetermined level and including a high-frequency time base and a multi-stage frequency divider coupled thereto to provide low-frequency timing pulses;

B. a stepping motor operatively coupled to said hands to drive same, said motor including a stator coil wound on a core and an auxiliary coil wound on said core, said auxiliary coil constituting the primary of a transformer whose secondary is said stator coil;

C. a driver stage responsive to said timing pulses to produce drive pulses which are applied to said stator coil to actuate said motor;

D. a d-c voltage source having a voltage output whose level differs from said predetermined level; and E. a voltage converter coupled to said source to produce an energizing voltage for said circuit means at said predetermined level, said converter incorporating said transformer and further including a pulse-actuated electronic voltage chopper interposed between said d-c source and said primary to supply a periodically-interrupted voltage thereto, thereby producing an alternating voltage at said secondary, a rectifier coupled to said secondary to yield said energizing voltage, and means to inhibit actuation of said chopper when said driver stage produces drive pulses to prevent interaction between the operation of said converter and said driver stage.

2. A timepiece as set forth in claim 1, wherein the ratio of said coils forms a step-up transformer.

3. A timepiece as set forth in claim 1, wherein said electronic chopper is constituted by a transistor having a gate electrode and is actuated by pulses applied to said gate, which pulses are derived from an intermediate stage in said divider.

4. A timepiece as set forth in claim 1, wherein said d-c source is constituted by a thermo-element battery.

5. A timepiece as set forth in claim 4, further including a buffer accumulator fed by the rectifier of said converter to provide a voltage output even when the thermo-element battery is inactive.

6. A timepiece as set forth in claim 1, wherein said drive stage includes means to short circuit the stator coil for a brief interval upon the conclusion of each drive pulse to brake said stepping motor.

7. A timepiece as set forth in claim 6, wherein said short circuiting means includes first logic means to determine when the drive pulse concludes.

8. A timepiece as set forth in claim 6, wherein said chopper inhibiting means is constituted by second logic means for rendering the voltage chopper inactive for a period which extends for the time when the drive pulse is fed to said stator coil followed by the short circuit interval.

* * * * *